United States Patent [19]

Lombardi

[11] Patent Number: 4,986,090

[45] Date of Patent: Jan. 22, 1991

[54] METHOD OF KNITTING

[76] Inventor: Victor J. Lombardi, 2715 Charlotte La., Burlington, N.C. 27215

[21] Appl. No.: 225,676

[22] Filed: Jun. 23, 1988

Related U.S. Application Data

[62] Division of Ser. No. 348,522, Feb. 12, 1982, abandoned.

[51] Int. Cl.[5] ..... D04B 9/12

[52] U.S. Cl. ..... 66/9 R; 66/93; 66/194; 66/229

[58] Field of Search ..... 66/9 R, 217, 229, 92, 66/93, 191, 194, 198

[56] References Cited

U.S. PATENT DOCUMENTS

| | | | |
|---|---|---|---|
| 1,949,319 | 2/1934 | McAdams | 66/191 |
| 2,098,446 | 11/1937 | Agulner | 66/93 |
| 2,116,358 | 5/1938 | Leedham et al. | 66/9 R |
| 2,207,397 | 7/1940 | Fleisher | 66/191 |
| 2,276,705 | 3/1942 | Smith, Jr. | 66/93 |
| 4,034,581 | 7/1977 | Swafford | 66/136 X |

*Primary Examiner*—Wm. Carter Reynolds
*Attorney, Agent, or Firm*—Rhodes, Coats & Bennett

[57] ABSTRACT

A method for operating a conventional circular knitting machine, provided with indepenent and continuously operating pattern wheels, to develop patterns including knit, tuck, welt and terry stitches in the same course(s). By synchronizing the sinker selection and needle selection components, in a complementary manner, the resulting tubular fabric may include terry loop areas adjacent to decorative flat-knitted areas which together comprise the entire circumference of said tubular fabric rather than the dull, uninteresting non-terry areas generally resulting in tubular fabrics which include terry areas in only a portion thereof.

11 Claims, 9 Drawing Sheets

METHOD OF KNITTING

This application is a division, of application Ser. No. 348,522 filed Feb. 12, 1982 now abandoned.

BACKGROUND AND SUMMARY OF THE INVENTION

This invention relates to knitted tubular fabrics of single jersey construction producible on circular knitting machines of sinker-top design and to methods for producing said knitted fabrics to incorporate upstanding terry loops at certain portions on the technical reverse side thereof in complementary association with other flat-knitted stitch effects appearing at certain other portions on the technical reverse side and/or on the technical face of the fabric. The terry loop portions and the complementary flat-knit stitch portions together may constitute the full circumference of the knitted tubular fabric if desired.

The circular knitting machines to produce the fabrics of the present invention include continuously rotating pattern wheel means for selective actuation of elongated loop forming sinker elements in synchronized and complementary relationship with continuously rotating pattern wheel means for selective actuation of ground stitch forming latch needle elements. As used herein the term "complementary relationship" means that where one selected pattern area, i.e., an area in which upstanding terry loops are formed ends, the other area, a non-terry area, automatically picks up. The resulting fabrics may include, for example, on the technical reverse sides thereof, certain areas in which upstanding terry loops may be made to appear complemented by other non-terry areas in which flat-knitted surface interest effects may be incorporated.

It is well known in the knitting art to form elongated sinker loops (i.e. terry loops) on the technical reverse side of a fabric by introducing at a yarn feeding station two yarns in a plated relationship, one yarn constituting the ground yarn, and the other, the loop or terry yarn. With this well-known technology, a ground yarn is first introduced into the throats of the sinkers; after the sinkers have been advanced by appropriate cam means, the second yarn, i.e. the loop or terry yarn, is introduced into the hooks of the needles from a position above the nibs of the sinkers. Consequently, when the needles are subsequently fully retracted by stitch cam means, common stitches of ground and loop yarn are knitted together forming the basic fabric web, whereas the loop of terry yarn introduced over the sinker nibs is formed into elongated upstanding sinker loops appearing on the technical backside of the fabric.

The knitting sequence described in U.S. Pat. No. 3,477,255, FIGS. *1a* through *2e*, illustrates this well-known technique. It is also well known, as specifically shown in FIG. *2a* of said U.S. Pat. No. 3,477,255, to advance selectively only certain sinkers to receive yarn over their nibs so that the elongated sinker or terry loops may be made to appear in patterned areas on the technical backside of the fabric and not elsewhere. The terry loop pattern areas may be regularly or randomly placed in symmetrical or asymmetrical arrangements, or combinations thereof.

It is also very old and well-known in the art to provide pattern wheel means for selective advancement of knitting elements, such as needles, to different yarn receiving levels whereby patterned effects in a ground fabric of single jersey are readily produced. These may be made to appear on either the technical face and/or the technical reverse side of the fabric. Such patterning means are described in U.S. Pat. No. 2,127,224.

It is also known in the art, as described in U.S. Pat. No. 2,116,358 to provide in a circular knitting machine needle selection drums and sinker selection drums intermittently and rotatably driven by means common to both. In this patent, the intermittently rotatable patterning drums for both needle and sinker selection comprise vertically positioned pattern drum means whose centerlines of rotation are vertical and thus parallel to the centerline of the circular knitting machine. Furthermore, the said intermittently rotatable pattern drum selection means interface with the sinker and needle knitting instruments through a multiplicity of intermediate cam elements, so that the said pattern drum selection means do not directly engage the knitting elements. Furthermore, during certain phases in the machine's operation, the pattern drum means for both the needle and sinker selection must be racked by conventional means well known in the art so that different pattern readings will be presented to their respective elements. These racking movements are synchronized at corresponding cylinder and dial locations.

In order to permit unencumbered racking movements of pattern drum means at the said cylinder and sinker dial locations, a narrow band of knitting elements, which normally would occupy these locations, is removed from the cylinder and sinker dial respectively.

Consequently, across the circumferential extent, no patterning is possible, and therefore, the tubular fabric produced is characterized by an unusable band in the fabric extending across the entire needle/sinker "out" area and running throughout the entire length of the fabric. Therefore, there is no possibility of using such fabric in tubular seamless body size applications.

In the subsequent finishing process, the tubular fabric is slit in the machine direction along this so-called needle/sinker "out" area. This restriction limits the knitgoods manufacturer who must slit the tubular fabric along the specific needle/sinker "out" portion rather than along some other position where, for example, defects in the fabric may exist.

On the other hand, pattern wheel selection as practiced in this invention is continuous, therefore not necessitating the removal of needles and sinkers from the cylinder and sinker dial members respectively. Consequently, continuous and uninterrupted patterning is readily achieved throughout the entire knitted tube of fabric. The fabric may, therefore, be slit along any wale location depending on the preferences of the manufacturer.

Furthermore, and importantly, since patterning with pattern wheel means is continuous throughout the circumference of the knitted tubular construction, pattern wheel selection as used in the present invention is uniquely suited to small diameter body size knitting wherein the fabric is finished in tubular form and subsequently cut and sewn tubularly for seamless body garment applications.

The fabrics of the present invention are producible by incorporating horizontally mounted pattern wheel means for sinker selection in combination with angularly mounted pattern wheel means for needle selection. The said pattern wheel means are continuously rotatable and derive their rotation by a direct meshing action with cooperating sinker and needle elements thus eliminating the requirement for intermediate camming. Further the sinker and needle pattern wheels are preferably provided with the same number of cuts so that the resulting pattern areas may be equal in width and depth.

The fact that the sinker and needle pattern wheels have an equal number of cuts will facilitate pattern preparation in that the sinker pattern wheel set-out and the needle pattern wheel set-out may be more simply and more expeditiously complemented with respect to each other so that where, for example, terry selection by sinker pattern wheel means stops, stitch selection by needle pattern wheel picks up, and vice versa. It will, however, be understood that although sinker pattern wheels and needle pattern wheels may preferably be of the same number of cuts, other combinations of cuts between the respective pattern wheels may likewise be advantageously employed to meet specific patterning requirements.

The method of the present invention resides in synchronizing the operations of these separate, independently operating distinct, pattern wheel means in novel cooperation whereby the terry patterning developed by the sinker pattern wheels is coordinated and complemented with the ground stitch patterning developed by the pattern wheels operating on the needles.

In other words, the sinkers are selectively advanced by continuously rotatable pattern wheel means at those positions in the fabric where terry loops are to appear. Simultaneously with this sinker selection, needles are directly selected to a full knit height in the same positions where terry loops are to appear. Furthermore, when sinkers are to remain retracted in their unselected positions in the so-called non-terry portions of the fabric, needle selection may be advantageously utilized to create unique ground stitch design effects comprising knit/tuck welt combinations and variations thereof. Consequently, selected needles cooperate with selected sinkers to form terry loops at first portions of the fabric; and furthermore, selected needles cooperate with sinkers selectively positioned to inoperative positions in other than an overall knit technique to form ground stitch effects at second portions of the fabric where terry loops do not appear. The first and second portions may easily be made within the same pattern areas, whereas those of the aforementioned U.S. Pat. No. 2,116,358 may not. By utilizing these two separate, distinct, and independently operating patterning systems in a novel and complementary manner, a broad range of surface, functional, and aesthetic effects are readily producible, thus enhancing patterning capabilities and market acceptance.

As noted earlier, a terry fabric produced on a circular knitting machine of sinker-top construction is, generally, referred to as single jersey in that knitted stitches are formed on a single set of needles and are pulled through to the technical face of the fabric. Fabric of this construction is characterized by a technical faceside in which knitted loops are readily discernible as vertical wales, and a technical backside, generally acknowledged to be flat, dull, and essentially nondescript. When upstanding terry loops appear on an overall basis on the technical backside of a single jersey fabric, they effectively conceal this essentially uninteresting base structure. However, in those instances where patterned or isolated terry effects are desired, the technical backside of the fabric is dull, flat and uninteresting at those areas where elongated terry loops are not formed. For example, if the terry loops are patterned in, say, a polka dot motif with the polka dots regularly dispersed on the technical backside of the fabric, the non-terry areas will be identical to the backside of a plain jersey fabric, i.e. dull, and completely devoid of surface interest.

Therefore, a primary objective of the current invention is to provide novel means whereby surface interest is developed at these normally plain areas. Accordingly, the patterned terry loop designs may be effectively enhanced and complemented by the development of surface interest effects in the adjacent non-terry loop portions of what normally constitutes the plain backside of the knitted fabric.

A further objective of the invention resides in the combination of patterned terry effects on the technical backside of the fabric and patterned ground stitch effects on the technical faceside and/or backside thereof by selective sinker actuation means synchronized to cooperate with selective needle actuation means.

The present invention further contemplates the addition of a third yarn into the terry fabric in a so-called non-knit manner so that the said third yarn when so incorporated occupies a position on the technical reverse side of the fabric, i.e. the same side on which the terry loops are made to appear. Inasmuch as this said third yarn component is not pulled through the loops of the previous course, but is introduced in a tuck or non-knit manner, it may be many times heavier than the ground and terry yarns and may in fact include novelty yarn such as boucle', seed, thick/thin, etc., in a broad range of constructions and sizes. Such a lay-in yarn need not have the strength requirements of the ground yarn. Furthermore, this lay-in effect yarn may be introduced on a regular overall basis on the technical backside, or, by appropriate needle selection means, may be caught into the fabric in a patterned lay-in configuration.

Inasmuch as both the terry loops and the lay-in effect appear on the technical backside of the fabric appropriate selection of terry loop-forming sinker elements in synchronized cooperation with appropriate selection of needles make possible the development of patterned areas of terry loops complemented by patterned areas developed with the effect or lay-in yarn.

When so introduced, the effect or novelty-type lay-in yarn effectively provides functional advantages, as well as aesthetics, to the knitted terry construction. Functionally, the effect yarn, by virtue of its introduction by non-knit or lay-in techniques, imparts, when required, improved widthwise stability to the knitted construction. Further, the heavy effect or lay-in yarn may be introduced at intermediate auxiliary feed positions between the terry loops of successive courses, thus helping the said terry loops in each as well as successive courses to be maintained more upstanding and, therefore, more respective to a subsequent shearing operation.

A major shortcoming of terry fabrics currently offered in the market which are to be sheared for a velour effect is that certain of the terry loops in the fabric have a tendency to lay somewhat inclined, well below the surface of other more upstanding terry loops. Consequently, when a fabric with this deficiency is to be sheared, the lower-lying loops remain untouched in the shearing process. Or, in order to insure that all terry loops are cropped, the shearing blade must be set sufficiently low to cut the lowermost terry loops. Understandably, this results in a lower overall sheared effect with resultant yarn waste. The introduction of a heavy lay-in yarn between the terry loops as provided in the current invention will help maintain terry loops of each and successive courses more erect and, therefore, easier to shear with a minimum of yarn wastage.

With regard to aesthetics, the incorporation of novelty yarns on the technical backside of a fabric in combination with terry loops on an overall or patterned basis may be effectively utilized in providing an added design element to enhance surface interest. If for example, the overall or patterned terry loop fabric incorporates a heavy boucle' novelty yarn introduced on a tuck or non-knit basis in one or more courses, and the terry loops subsequently sheared to a level, slightly above the level of the novelty yarn, then unusual fabric effects may be readily achieved in a broad range of sheared loop and novelty yarn combinations. Fabrics of this construction suggest excellent applications in apparel and upholstery.

Furthermore, for example, the terry loop portions on the backside of the fabric may appear as isolated upstanding polka dot motifs, and the remaining complementary potions, as flat patterned three-position effects in the ground fabric. In this instance, the terry loops yarn and the ground or body yarn constitute just the two yarns utilized throughout the knitted construction.

The invention further contemplates methods for producing patterned terry loop motifs in fabrics in combination with non-knit stitch effects, such that only terry loop yarn and ground yarn are used throughout the knitted construction. In the patterned terry portions developed at a specific feed, the terry yarn may be introduced over the nibs of selected sinkers and the ground yarn, into the sinker throats of all sinkers in the conventional way. At the same feed, when unselected sinkers remain outwardly inactive, ground stitches of plain jersey construction are formed with both the ground and so-called terry loop yarns again in a conventional manner. At a successive feed, however, at those portions where sinker elements are maintained outwardly inactive, needles may be selectively positioned to tuck and welt heights. Consequently, both the so-called terry yarn and ground yarn at said successive feed are caught simultaneously into the fabric in a non-knit or lay-in manner at those locations where terry loops are not formed. Consequently, by appropriate selection means, a broad range of unique patterned terry effects may be effectively combined with lay-in effects comprising the same terry and ground yarns only.

Likewise, sinker selection means may be synchronized with needle selection means, whereby knitting needle elements may be selectively positioned to knit, tuck, and welt levels. In these instances, the so-called terry loop yarn and the ground yarn are utilized alone throughout the fabric as noted above, combining to form areas of terry loops and complementary non-terry areas characterized by flat stitch knit, tuck, and welt combinations.

As previously described, where terry loops are to appear in a patterned configuration, the ground yarn is introduced into the throats of all sinkers and the terry yarn introduced above the nibs of selected sinkers. When the needles are subsequently retraced by conventional cam means, patterned terry effects are produced at those locations on the backside of the fabric where such sinker selection has been effected.

However, by synchronizing the needle selection to knit, tuck or welt levels at those locations in the fabric where terry loops are not formed, i.e., where sinkers are maintained in non-selected positions, then the so-called terry yarn and the ground yarn may be interknitted together in the base ground fabric in a plated relationship to provide patterned ground areas of non-terry loop construction to complement the patterned terry areas. The said patterned ground areas may be made to appear on the technical backside and/or faceside of the fabric. Consequently, by appropriate and complementary selection of both sinker elements and needle elements, whose actuations are synchronized with respect to each other, distinct and complementary pattern areas of terry loop and ground structure may be readily achieved in a broad range of novelty effects.

The invention resides further in a fabric produced on a machine of sinker-top construction with appropriate sinker selection and needle selection synchronized with respect to each other whereby terry loops are selectively formed at certain backside positions of the fabric as previously described. At other backside portions where terry loops do not appear, needles are selectively raised to a knit level higher than the normal knit position so that the so-called terry yarn is introduced on top of the latches of the selected needles, and the ground yarn, below the latches of selected needles. Inasmuch as certain needles are raised selectively to a high knit level, the ground yarn now occupies a position below the latches of these selected needles whereas the loop yarn will be on the latches of all needles. Consequently, when the needles are subsequently retracted by conventional cam means, while the terry yarn will be caught in the needle hooks and pulled down into loops, the ground yarn below the latches of selected needles, will pass up over the cheeks of these selected needles together with the previously formed loops thereby closing their latches and passing over the hooks of these needles into the fabric web. A lace-like open structure is thus made to appear at those places where needles have been selected to a high knit level. At those places where needles are raised to a conventional knit level, of course, the terry and ground yarns are both introduced above the needle latches and subsequently interknitted forming a standard jersey stitch comprising the two yarns in the basic fabric.

With this method, patterned terry loops effects on the technical backside may be effectively combined with other areas of lace-like open structure and plain jersey construction.

In addition, sinker selection as previously described for producing terry loops at specific portions on the technical backside of the fabric may be synchronized with appropriate selection of needles with forward hook construction whereby the so-called terry yarn is fed into the hooks of only the selected forward hook needles. When the forward hook unselected needles are subsequently advanced by conventional raising cam means to receive the ground yarn, the terry loop yarn is positioned behind these advancing needles. The terry yarn so introduced will be subsequently cast off over the hooks of the selected needles, thus creating lace-like open structures in the fabric web. Said lace-like open structures may be made to appear at the non-terry loop areas on the technical backside of the fabric. By virtue of the porous, lace-like fabric structure, a comfort factor is also achieved thus enhancing functional as well as aesthetic features of the knitted construction.

These and additional features and advantages of the present invention will be discussed in greater detail below. In the detailed discussion, reference will be made to the accompanying drawings, as follows.

DETAILED DESCRIPTION OF A PREFERRED EMBODIMENT

Figure 1:
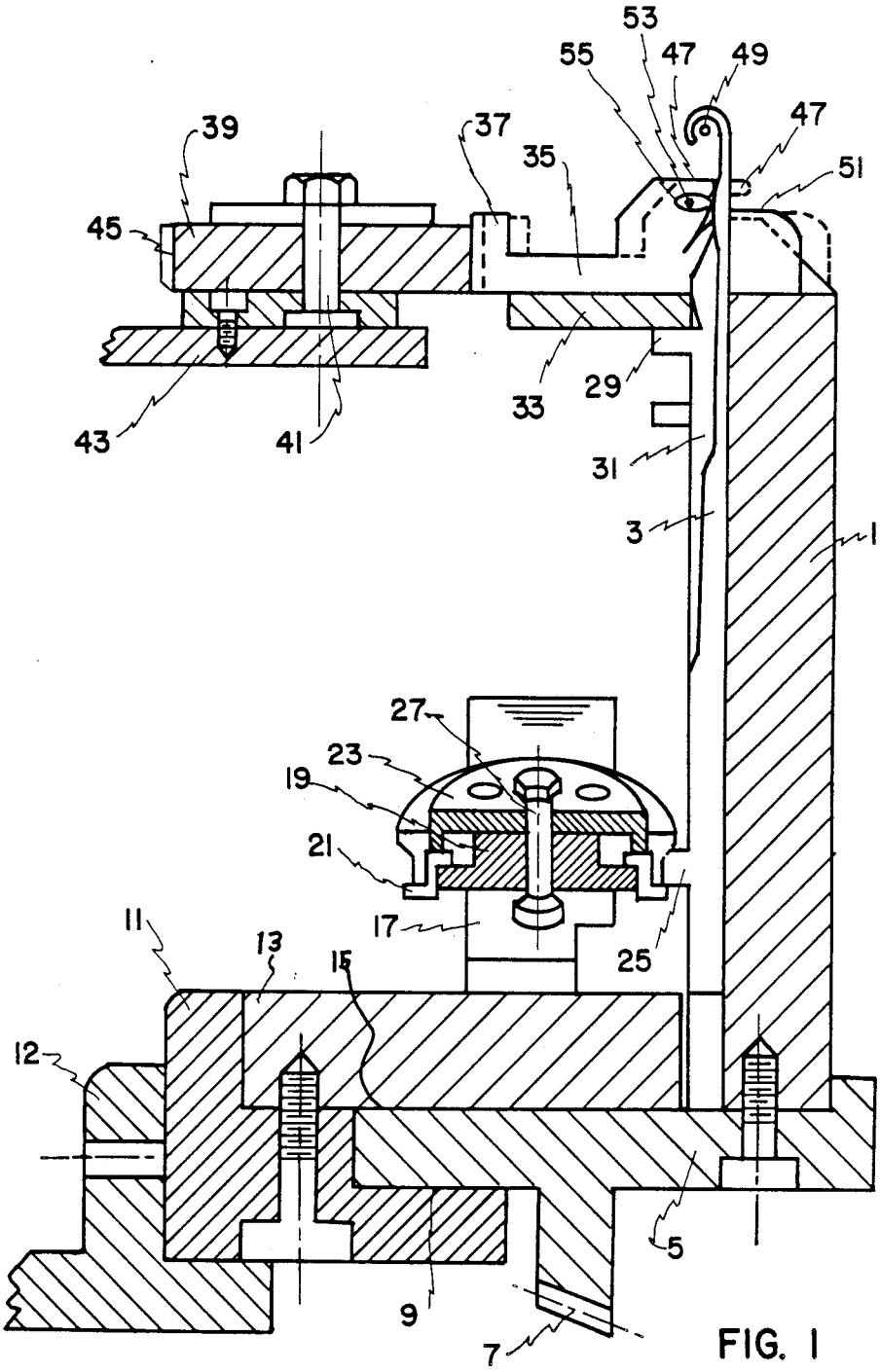
FIG. 1 is a sectional elevation view of a machine of sinker-top construction incorporating sinker and needle pattern wheel selection means which may be utilized in producing fabrics of the present invention.

To produce the knitted fabrics of the present invention, there is shown in FIG. 1 a sectional elevation view of a machine of sinker-top construction incorporation pattern wheel means for selecting independently sinker and needle elements in synchronized relationship. Cylinder member 1 is slotted around its entire circumference to receive a multiplicity of needles 3 vertically operable in their respective slots in a conventional manner.

Cylinder member 1 is fixedly mounted to rotating ring member 5 which receives its motion by conventional motor driven gear means not shown meshing with gear ring 7. Ring member 5 is in sliding engagement at 9 with bedplate 11, mounted on conventional supports 12 in a manner well known in the art.

Restraining annular ring 13 is mounted on bedplate 11 with minimal clearance at 15 to permit free rotation of ring member 5 but preventing its vertical movement. Secured on ring 13 by means not shown is pattern wheel bracket 17 on which is mounted an inclined three-position pattern wheel 19 as described in U.S. Pat. No. 2,127,224.

Pattern wheel 19 is slotted around its circumference to receive a multiplicity of bitt elements 21. Cap member 23 fastened by conventional screw means maintains the said bitts 21 in a prescribed configuration. The pattern wheel 19 engages the butts 25 of needles 3 in a meshing relationship. In view of cylinder rotation, needle butts 25 of needles 3 cooperate with pattern wheel 19 causing the said wheel 19 to rotate around post member 27. Bitts 21 may be of high or low design. When of high design, the bitt engages a cooperating needle butt, causing the associated needle to be elevated to knit height. When the bitt 21 is of low design, as depicted in FIG. 1, the cooperating needle is raised to a tuck height as shown. If there is no bitt in a certain pattern wheel slot, the cooperating needle will not be acted upon and thus remains at its unselected or welt height. Inasmuch as the bitts may be inserted in the pattern wheel in virtually an unlimited number of arrangements, the needles themselves may be positioned to knit, tuck, or welt levels in any desired configuration. Consequently, broad jacquard effects may be readily developed with the system. These include designs on the technical face or backside of the fabric.

Mounted on shoulder 29 of cylinder insert member 31 by conventional means not shown is sinker dial member 33 radially slotted to receive a multiplicity of sinkers 35 which cooperate with needles 3 in a conventional manner during the knitting process. Outwardly of sinker dial 33, and in meshing engagement with butts 37 of sinkers 35, are horizontally mounted pattern wheel means 39. The said wheel means 39 rotate about post 41 fixedly mounted to bracket means 43 to selectively activate sinkers 37 in a well-known manner.

Pattern bitts mounted in certain of the slots 45 in the circumference of wheel means 39 imparts selective inward radial movement to cooperating sinkers 35. When a sinker is so selected, it is radially advanced so that the sinker nib occupies a position 47' inwardly of the needle 3. Consequently if a ground yarn 53 is first introduced into the throat 55 of sinker 35 and a terry yarn 49 is fed into the needle hook from a position above advanced sinker nib 47', and the needle subsequently retracted by conventional cam means, an elongated terry loop will be formed over the said sinker nib 47', and a ground loop formed over sinker belly 51. On the other hand, if the sinker remains unselected in its outer or retracted position, short loops with yarns 49 and 53 will be formed over the belly 51 of sinker 35. Inasmuch as the bitts in the horizontal pattern wheel may be set out in any desired configuration, broad patterning scope in terry fabric is possible. Therefore, certain areas on the technical backside of the fabric may have elongated terry loops, whereas in other areas, common ground stitches are formed over the sinker belly 51, comprising yarns 49 and 53 to form patterned flat knit jersey stitch effects comprising knit/tuck/welt combinations in a conventional manner.

In the present invention, the selective needle actuation by inclined pattern wheel means 19 is synchronized with the selective sinker actuation by horizontal pattern wheel means 39 so that patterned areas of flat knit stitch effects comprising knit/tuck/welt combinations developed by needle selection are complemented by pattern areas comprising upstanding terry loops developed by sinker selection in an unlimited number of combinations. Consequently, in those portions on the backside of the fabric where terry loops are not selectively present, jacquard ground stitch effects may be introduced by virtue of needle selection. Similarly, when jacquard flat stitch effects are not selectively present, upstanding terry loops may be introduced by sinker selection. These jacquard flat stitch effects may appear either on the same side as the patterned terry areas, i.e. the technical backside, or the flat stitch effects may also appear on the opposite face of the fabric, i.e. the technical face side. By this novel method of combining and coordinating independent patterning means on sinkers and needles, a broad range of fabric possibilities is available beyond the scope of existing patterning limitations determined by needle selection alone or sinker selection alone.

I have found that sinker and needle selection may be effectively synchronized and complemented when the pattern wheel means used for sinker selection contains the same number of cuts as the pattern wheel means used for needle selection. For example, in a 26" diameter 18-cut 1500 needle machine, using sinker pattern wheels and needle pattern wheels of 120 cut respectively, synchronizing and complementing sinker and needle selection are greatly facilitated, thus ensuring that when sinker selection in a specific knitted course is completed, needle selection in the same knitted course will precisely commence. Thus when terry selection by the sinker pattern wheel stops in selected areas, stitch selection by the needle pattern wheel commences immediately in areas complementary to the aforesaid selected areas and vice versa. However, as noted previously, although sinker pattern wheels and needle pattern wheels may preferably be of the same number of cuts, to provide respective and resulting pattern areas of equal width and length other combinations of cuts between the respective pattern wheels may likewise be advantageously employed to meet specific patterning requirements.

Figure 2:
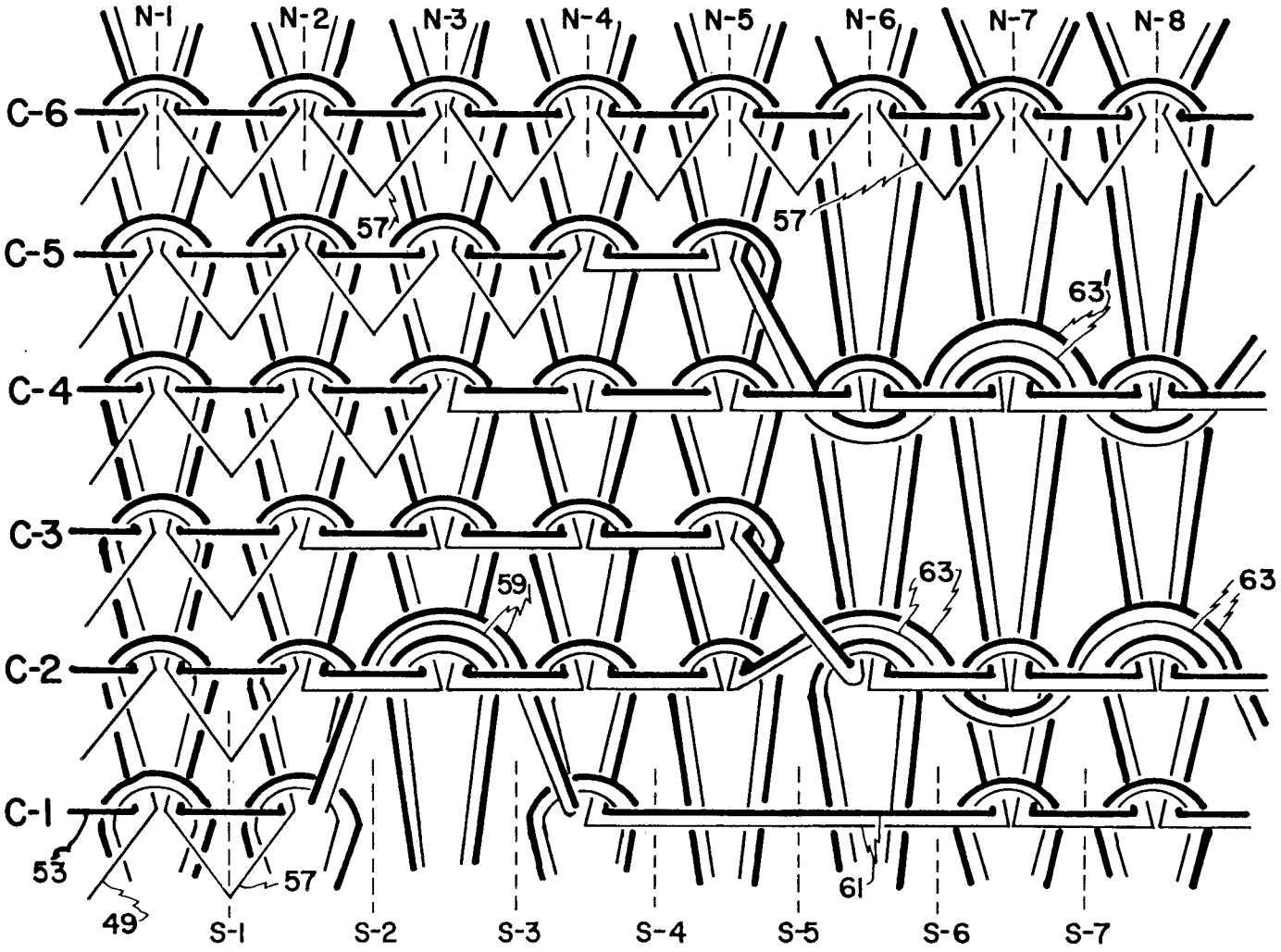
FIG. 2 is a schematic stitch representation of a portion of one fabric of the present invention.

FIG. 2 is a schematic stitch representation of one knitted fabric of the present invention viewed from the technical reverse or backside of the fabric. Courses are indicated by C-1, C-2, etc.; needle wales by N-1, N-2, etc.; and sinker wales by S-1, S-2, etc. Two yarns are introduced in each course (feed) comprising a ground yarn 53 and a terry yarn 49. Ground loops of both yarns formed into needle wales, N-1, N-2, etc., constitute the so-called fabric web.

By means of sinker selection in the FIG. 2 illustration, elongated sinker or terry loops 57 are formed in the sinker wale S-1 of all courses C-1 through C-6. Furthermore, terry loops 57 occur in all sinker wales S-1 through S-7 in course C-6. By sinker selection, the terry loops 57 may be made to appear in certain sinker wales and not others. For example, in courses C-1, C-2, and C-3, elongated terry loops appear in sinker wale S-1 only. In course C-4, by sinker selection, elongated terry loops are formed in sinker wales S-1 and S-2 and not in other sinker wales of the same course.

It will be noted that in those areas when sinker selection is not in effect, i.e., where elongated terry loops 57 are not formed, needle selection to other than an overall knit position is effected in certain wales of certain courses to enhance patterning within the so-called non-terry areas. For example in course C-1, terry loop 57 appears in sinker wale S-1. Both ground yarn 53 and terry yarn 49 are interknitted to form needle wales N-1 and N-2. However, in needle wave N-3, these yarns do not form common ground knitting stitches. Rather, by virtue of needle selection to a tuck level, ground yarn 53 and loop yarn 49 are caught into the fabric in a tuck arrangement 59 as illustrated. As best shown in FIG. 1, such an arrangement would be produced when the needle 3 is selected to a tuck level and the sinker 35 remains in its unselected rearward position as shown by the sinker in solid line.

Further, in connection with course C-1, ground yarn 53 and loop yarn 49 are floated as shown at 61 across the backside of needles in needle wales N-5 and N-6. This would result when sinkers are maintained in their rearward unselected positions, and needles at N-5 and N-6 are maintained in unselected welt positions, thereby causing the ground and loop yarns introduced at course C-1 to pass over the backs of unselected needles as floats 61 in the fabric.

It will be observed in connection with course C-2 that by virtue of needle selection to tuck height in needle wales N-6 and N-8, the ground and terry yarns are incorporated in a non-knit manner as a lay-in effect 63, caught into the fabric at course C-2 and subsequently cast off into the fabric at course C-3. Similarly, in course C-5, the ground and terry yarns are caught into the fabric in a non-knit lay-in manner as shown at 63'. Looking at course C-2 in needle wale N-7, the needle has been maintained at a welt position and therefore the combination of yarns 49,53 floats across the loop in needle wale N-7. It will be clear that by appropriate sinker selection and sinker non-selection in synchronized cooperation with appropriate needle selection and needle non-selection, an unlimited range of designing possibilities is readily available.

Figure 3:
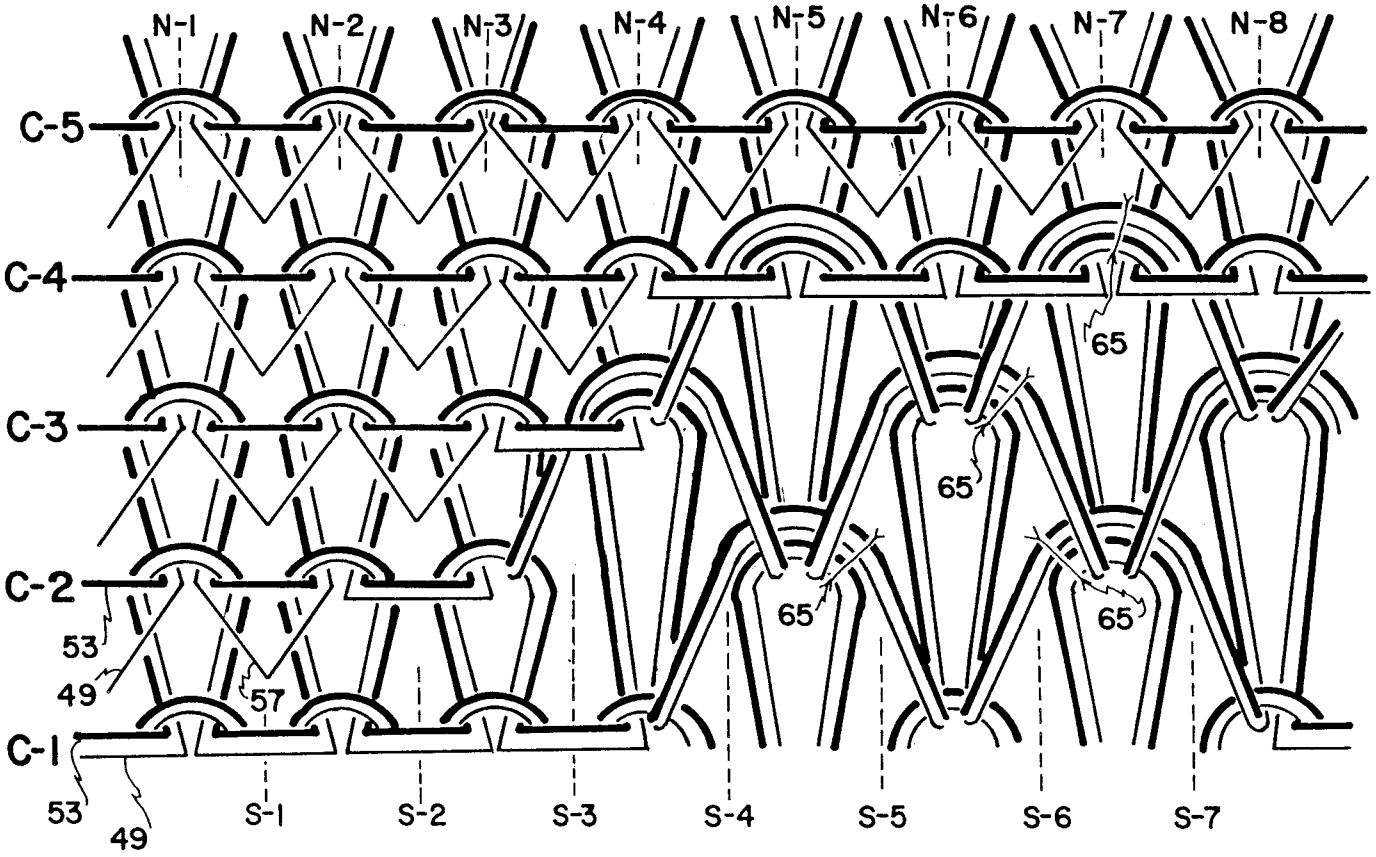
FIG. 3 is a partial schematic representation of another fabric of the present invention.

FIG. 3 is a schematic stitch diagram of another fabric of the present invention viewed from the technical backside thereof. Identical considerations as described in connection with FIG. 2 are applicable in FIG. 3. However, it is to be noted that by appropriate sinker non-selection in synchronized cooperation with needle selection as depicted in needle wales N-5, through N-8, held or tuck stitches are formed at 65 comprising both ground and terry yarns. It will be understood that these design effects may be made to appear at selected positions on either the backside or the faceside of the fabric.

Figure 4:
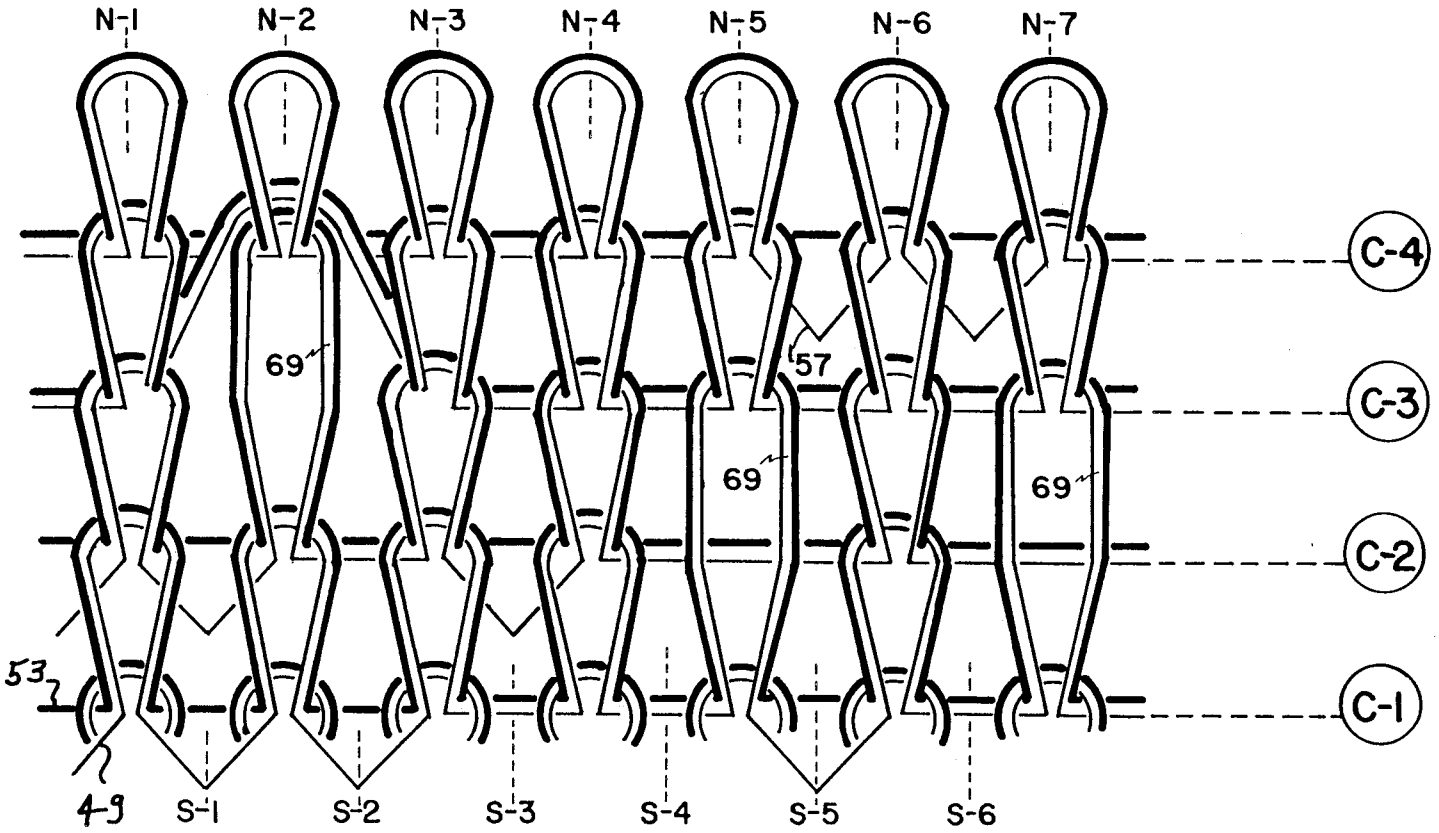
FIG. 4 is a partial schematic representation of yet another fabric of the present invention viewed from the technical face side.

FIG. 4 is a schematic stitch diagram of another fabric of the present invention viewed from the technical face side. By virtue of sinker selection as set forth hereinabove, elongated terry loops 57 as shown are made to appear at certain sinker wale positions in certain courses. Needle selection may be effectively utilized to create elongated ground stitches depicted as face loop effects 69 comprising ground and terry yarns as illustrated. Terry loops 57 and elongated ground stitches or face loops 69 may be made to appear randomly throughout the fabric in symmetrical, asymmetrical, or in other patterned configurations.

Figure 5:
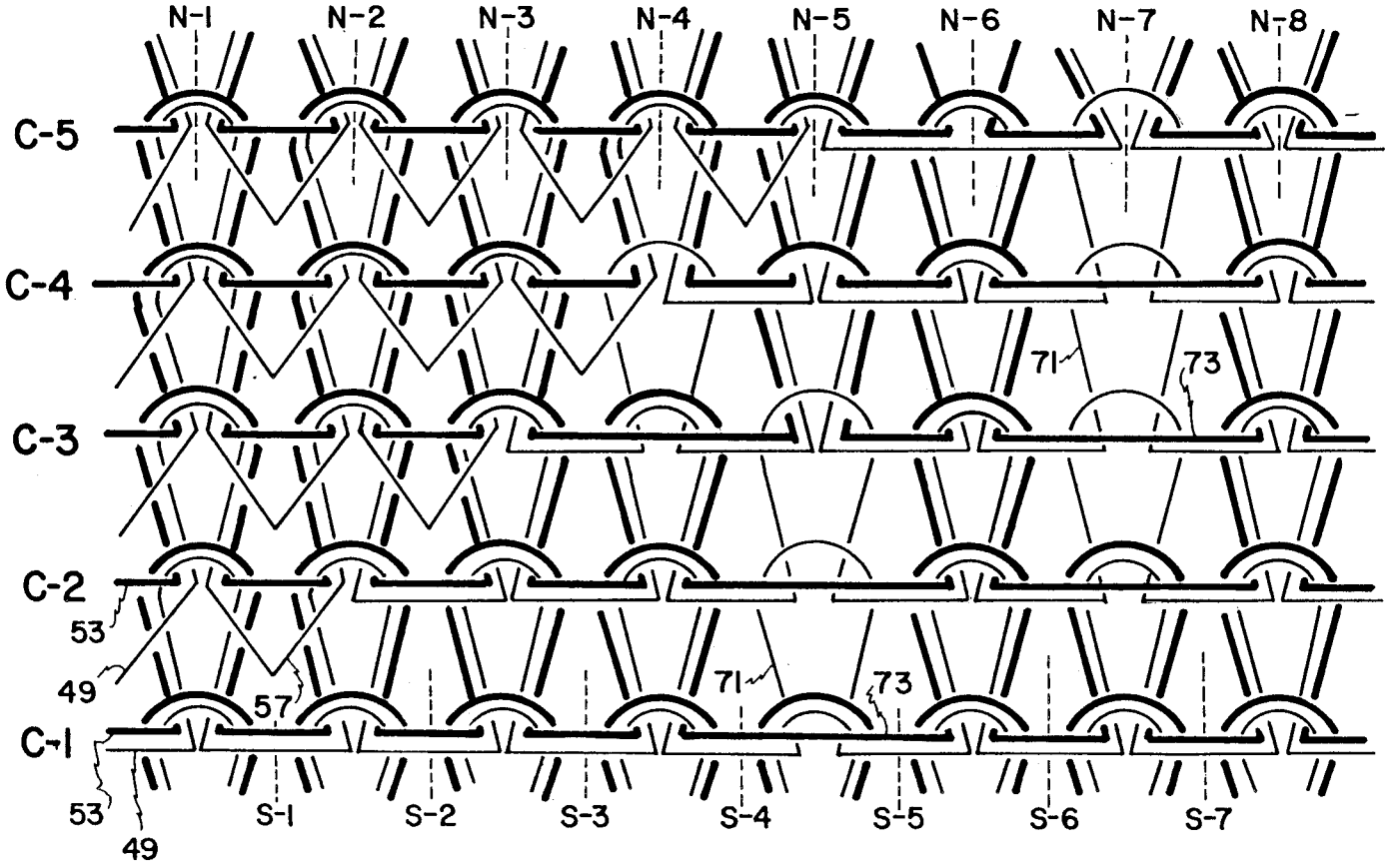
FIG. 5 is a representation of still a further fabric of the present invention.

FIG. 5 is a further schematic stitch representation of another fabric of the current invention viewed from the technical backside. It will be noted that again terry loops 57 as described above appear in a selective basis in the various courses. For example, here no terry loops appear in course C-1; terry loop 57 appears in sinker wale S-1 of course C-2 etc. It will be further observed that in course C-1 and needle wale N-5, the loop yarn 49 (sometimes referred to as the "terry loop yarn") is formed into a conventional single stitch 71, whereas the normal ground yarn 53 is permitted to pass across needle wale N-5 as a float 73. This action results in a lace-like open effect which may be made to appear selectively in the so-called non-terry loop areas of the fabric.

Figure 6:
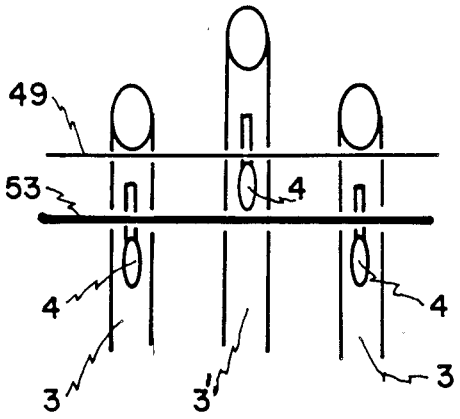
FIG. 6 is a frontal view illustrating the relationship existing between yarns and needles in producing portions of the fabric depicted in FIG. 5.
Figure 7:
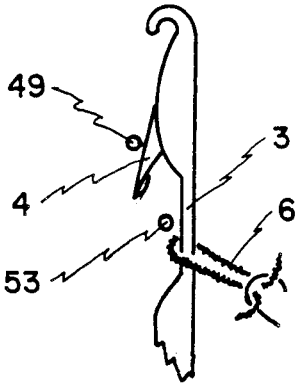
FIG. 7 is a side view showing the needle 3' of FIG. 6.

For a fuller understanding of this action, there is shown in FIG. 6 a frontal view of adjacent needles 3, 3', 3 operative in cylinder 1 (FIG. 1). It will be observed that terry yarn 49 and ground yarn 53 are introduced through a yarn carrier in a conventional manner as heretofore. However, by needle selection means, needle 3' is advanced to a knit position higher than the knit position of adjacent needles. Consequently when the ground yarn 53 is introduced, it will rest on top of latches 4 of the illustrated outer needles 3 and below the latch 4' of the center needle 3'. As best shown in FIG. 7, when all needles are subsequently retracted by conventional cam means to draw a new loop, yarn 53 will pass up the stem of needle 3', over the latch 4' closed by fabric loop 6 and pass into the fabric as float 73 as illustrated in FIG. 5.

Needle selection in the so-called non-terry areas makes possible the development of lace-like open effects on a random or patterned basis.

Figure 8:
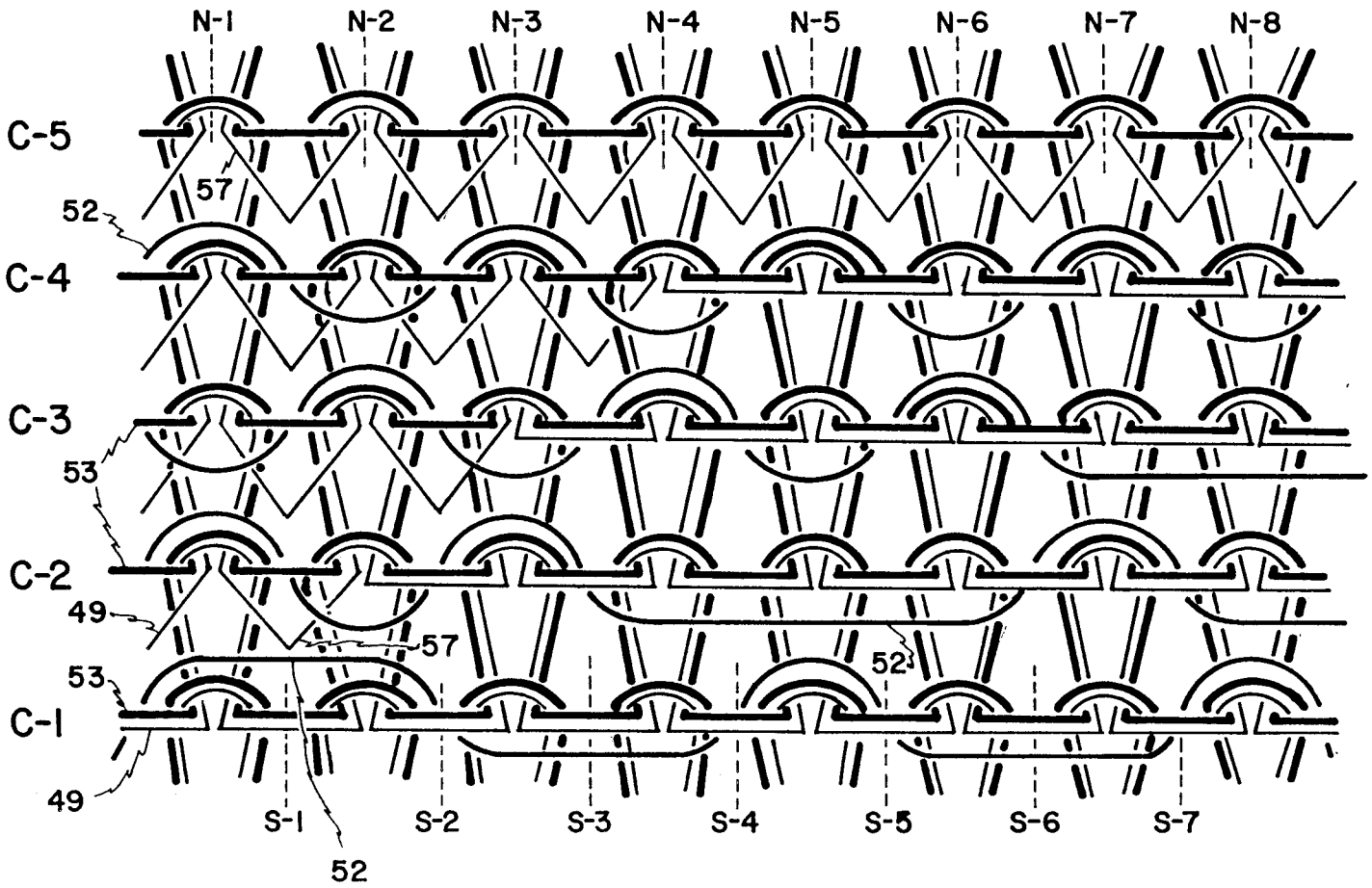
FIG. 8 is a representation of still a further fabric of the present invention.

FIG. 8 illustrates a schematic stitch representation of a further fabric made possible by the present invention, viewed from the technical backside. A third yarn 52 is selectively introduced into the construction in a non-knit or lay-in manner. As described in connection with the other fabrics of this invention, terry yarns 49 and ground yarns 53 are introduced as heretofore. However, by means of pattern wheel selection operating of sinkers, elongated sinker loops 57 are made to appear selectively in different courses as illustrated.

Effect yarn 52 may be introduced in a non-knit manner selectively or on an overall basis on the technical backside of the fabric. Furthermore, effect yarn 52 may be introduced in all courses, or in certain of the courses.

The effect yarn 52 is not introduced simultaneously with the ground and terry yarns. Rather it is fed at separate feeds between adjacent courses in which ground and terry yarns are being fed to form the base structure. More specifically, after the ground and loop yarns are introduced at a specific feed and knitted into the fabric, the effect or lay-in yarn is introduced at a following feed. At this feed, needles are selectively raised to tuck height, with unselected needles remaining at a welt level. The resulting effect achieved is that yarn 52 is caught into the hooks of selected needles and positioned behind unselected needles. By appropriate needle selection at these so-called lay-in feeds, various float arrangements may be developed to produce balanced or patterned lay-in designs. Patterned lay-in designs may be advantageously located in certain areas on the technical backside of the fabric to complement patterned terry loop area also appearing on the backside.

As shown in FIG. 8, effect yarn 52 is interlaced in course C-1 such that it is positioned in the hooks of needles of needle wales N-1 and N-2 as well as N-5 and N-8 and behind needles occupying needle wale positions N-3 and N-4 as well as N-6 and N-7. In course C-4, effect yarn 52 is interlaced in the hooks of alternate needles N-2, N-4, N-6, etc. and behind the needles of the intermediate needles in 1X1 configuration.

When the effect yarn 52 is caught on a 1X1 basis into a fabric of overall terry loop construction, i.e., terry loops appearing in all sinker values in all courses, the effect yarn serves additional functions. It adds stability and density to the resultant fabric; it helps maintain terry loops more erect to facilitate a subsequent shearing operation; finally, the effect yarn may be used to add a further design capability to the fabric enhancing its functionality and aesthetics.

Figure 10:
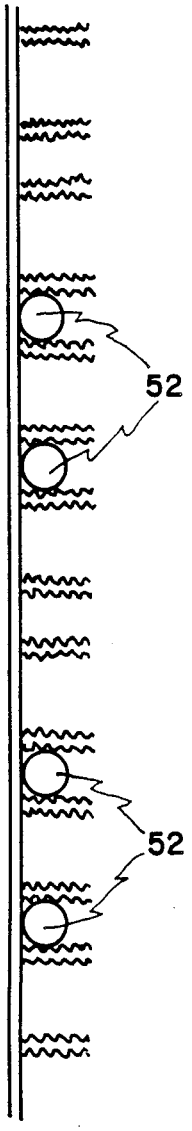
FIG. 10 is a representation of the fabric of FIG. 9 sheared along line AA.
Figure 9:
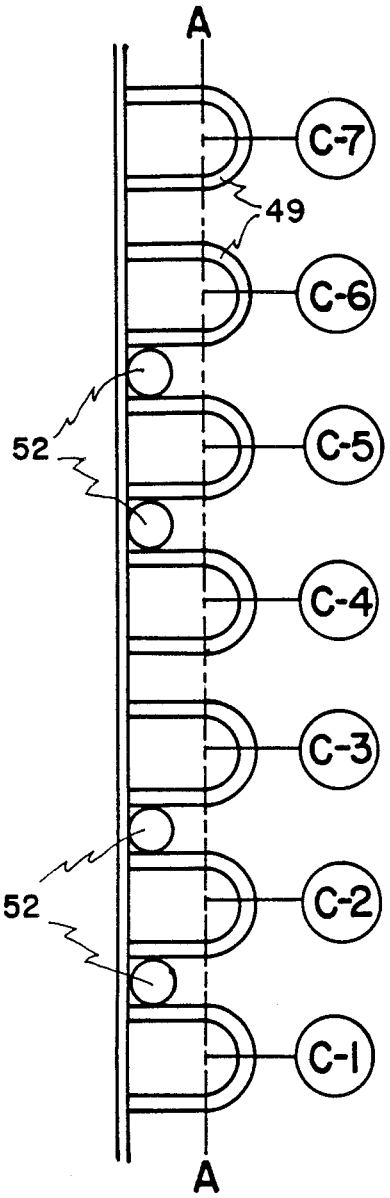
FIG. 9 is a profile view of a portion of the fabric of FIG. 8.

FIG. 9 is illustrative of a terry fabric of the present invention in profile with successive courses running from bottom to top and with terry loops 57 appearing in each course. In certain of the courses, for example courses C-1, C-2, C-3, etc., an effect yarn 52 is introduced on a lay-in basis as previously described in connection with FIG. 8. It will be observed in FIG. 9 that the effect yarn 52 may be introduced to help maintain the terry loops 57 more erect and, therefore, better positioned for a subsequent shearing operation. When sheared along lines AA of FIG. 9, the fabric in profile illustrated in FIG. 10 results with the shirred terry loops 57 of FIG. 9 depicted as 57' in FIG. 10. The placement of effect yarn 52 between adjacent courses, as for example courses C-1, C-2, and C-3, makes possible a denser and more erect sheared loop effect. It will be understood that a heavier effect or lay-in yarn may be introduced to extend slightly below the level to which the fabric is to be sheared. The whole family of novelty yarns might then be advantageously utilized as the effect or lay-in yarn, thus broadening functionality, eye appeal, and hand of the final product.

Figure 11:
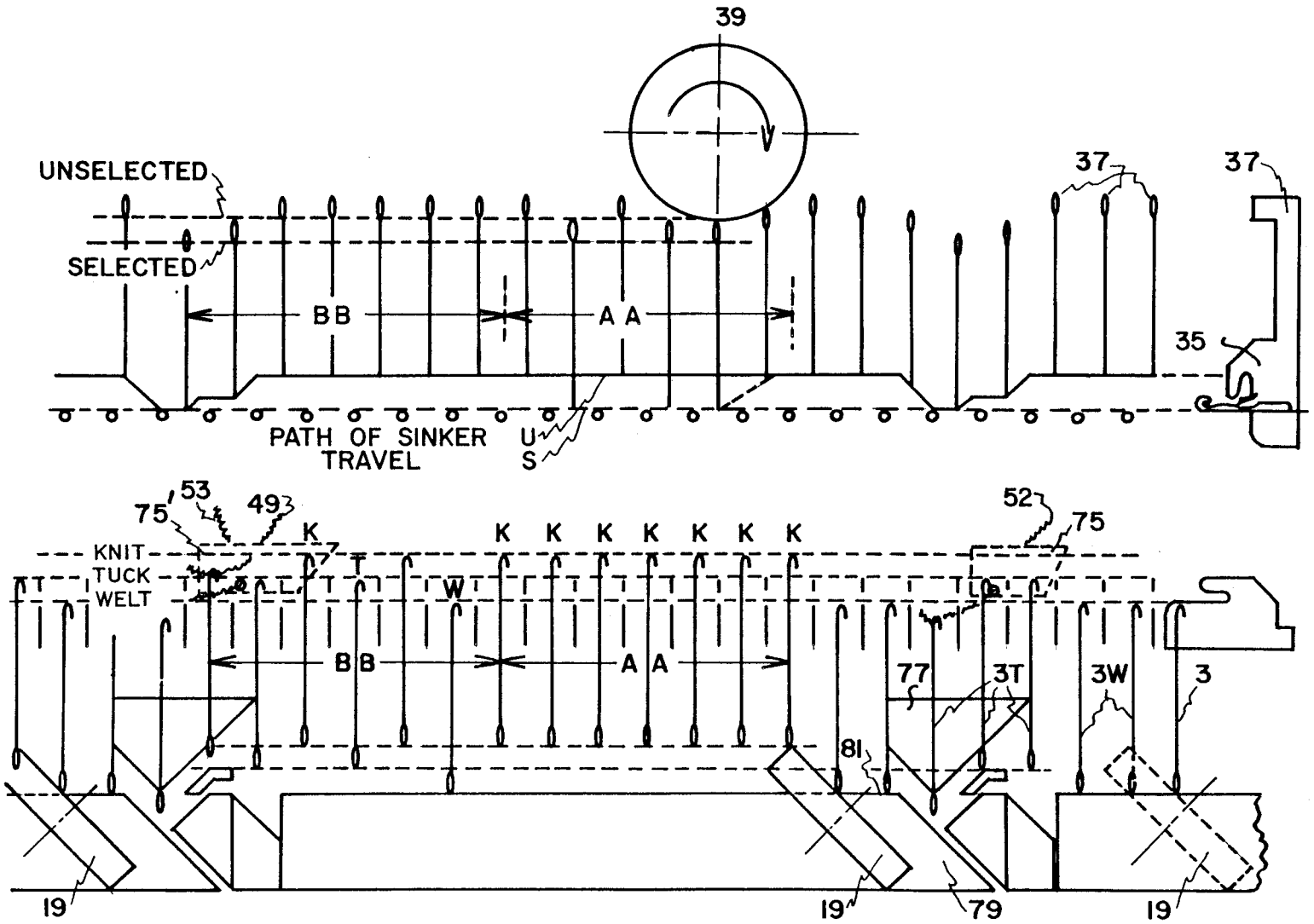
FIG. 11 is a diagrammatic development of a portion of a knitting machine so adapted to produce the fabrics of the present invention.

FIG. 11 depicts diagrammatically a development of a portion of a knitting machine adapted to perform the steps of producing the fabrics of the present invention.

Inclined pattern wheels 19 are provided to selectively position needles 3 at knit, tuck or welt levels dependent upon the final fabric required. Horizontally mounted pattern wheel means 39 in meshing engagement with sinker butts 37 of sinkers 35 selectively advance certain sinkers to terry loop forming positions while maintaining others in unselected non-terry loop forming positions as indicated. The meshing action between pattern wheel means 39 and the sinker butts 35 cause the wheel to rotate continuously clockwise as indicated by the arrow.

As shown when acted upon by sinker pattern wheel means and conventional sinker camming, sinkers will follow either of two paths of travel. When selected, sinkers will travel the path indicated as "S". If unselected, sinkers will travel the path indicated as "U". Terry loops will be formed by selected sinkers and not by others.

As shown to the right in FIG. 11, in preparation for the auxiliary feed, inclined and continuously rotating pattern wheels means 19' shown in dotted lines has selectively raised needles 3T to tuck height. Needles 3W pass through the pattern wheel unselected and remain at a welt level. Coincident with this needle selection, sinkers 37' remain in unselected positions. As the knitting process proceeds, an effect yarn 52 is guided by yarn carrier 75 into the hooks of needles 3T selected to a tuck position. All needles are subsequently fully retracted by stitch cam means 77 in a conventional manner.

As explained earlier, the effect yarn 52 is fed at a feed which is intermediate between adjacent feeds; at said adjacent feeds, ground and terry yarns are introduced in a plating relationship. Inasmuch as needles shown in FIG. 11 were selected by pattern wheel means on a 2X2 basis, i.e. two needles tuck, two needles welt, this configuration can be clearly seen in FIG. 8 between courses C-1 and C-2. More specifically, it will be observed that effect yarn 52 is caught behind the needles in needle wales N-3 and N-4 and in the hooks of needles in needle wales N-1 and N-2.

After all needles have been fully retracted by stitch cam means 77 as described earlier, they are advanced to an inactive neutral position 81 by raising cam 79. From this position, they enter into the path of inclined pattern wheel 19 which selectively raises certain needles to knit or tuck heights while maintaining others at an unselected welt level. For example, as illustrated, needles designed K have been selected to knit height; those designated T, to tuck height; and those designated W are maintained at a welt or unselected position.

It will be noted that all needles have been selected to knit height between positions indicated by arrows AA. Coincident with this needle selection, the cooperating sinkers have been selected by pattern wheel means 39 so that in the same AA positions, sinkers designated by "S" have been advanced to terry loop forming positions, whereas those designated "U" remain in unselected non-terry loop forming positions. Consequently, the needle selection in section AA is so coordinated and synchronized with the sinker selection in section AA that terry loops are selectively formed over certain of the sinkers and not over others.

Furthermore, it will be noted in the cylinder position designated BB that needles have been selectively positioned to occupy knit, tuck, and welt heights. Coincident with this, it will be observed that sinkers in position BB remain retracted in unselected positions. Therefore, no terry loops will be formed in the BB sinker area whereas needle selection in the same BB area makes possible the development of 3-position stitch effects at those portions of the knitted fabric where elongated terry loops have not been formed.

At a following feed, yarn carrier 75' introduces ground yarn 53 and terry yarn 49 into the hooks of selected needles. Coincident with this, the terry yarn is fed above the nibs of selected sinkers and subsequently drawn to elongated terry loops at certain portions of the fabric.

The fabrics described in FIG. 3 and 4 are illustrative of 3-position needle selection effects in certain portions of the fabric in association with terry loop effects in other portions of the fabric.

While various embodiments have been described in detail hereinabove, it is apparent that various changes might be made without departing from the scope of the invention as set forth in the claims below.

What is claimed is:

1. A method of knitting a decorative fabric on a circular knitting machine having continuously operating pattern wheels for independent sinker selection operative at a single level with said pattern wheels cooperating with a full complement of sinker elements extending around the entire circumference of the sinker dial of said machine for selectively activating sinkers between first retracted non-terry loops forming positions in which the nibs of said sinker elements are out of the path of the yarn caught in the hooks of needles on opposite sides thereof and second advanced terry loop forming positions in which the nibs of the sinkers are in the path of the hooks of needles on opposite sides thereof, and continuously operating pattern wheels for independent needles selection on the full complement of needles for selectively activating needles to a plurality of different heights, and a plurality of feeds, said method comprising the steps of:

(a) introducing in at least one of said plurality of feeds at least a first ground yarn at substantially a sinker throat level and at least a second yarn at a higher level above the nibs of the sinkers;

(b) selectively advancing at the same ones of said feeds selected ones of said sinkers according to a prescribed pattern to said second advanced terry loop forming positions in selected areas of said decorative fabric; and simultaneously;

(c) selectively advancing at the same ones of said feeds selected ones of said needles to knit height in the said selected areas of said decorative fabric in cooperate with said selected sinkers in the same said selected areas in forming elongated or terry loops over the nibs of said sinkers selectively advanced in said selected areas; and (d) selectively maintaining at the same ones of said feeds selected ones of said sinkers in retracted non-terry loop forming positions in areas complementary to said selected areas while simultaneously and selectively advancing cooperating needles to a plurality of different positions to form knit, tuck, and welt stitch combinations with at least one of said first yarn and at least a second yarn in said areas complementary to said selected areas.

2. The method to claim 1 wherein in step (d) the said plurality of different positions include tuck and welt combinations in selected wales of selected courses.

3. The method according to claim 1 wherein in step (d) the said plurality of different positions include knit and tuck combinations in selected wales of selected courses.

4. The method according to claim 1 wherein as said needles are elevated to said tuck or said welt position, both said first and second yarns are fed into the hooks of needles selected to tuck height and behind the hooks of needles maintained at welt height.

5. The method according to claim 1 wherein in step (d) the said plurality of different positions include knit and welt combinations in selected wales of selected courses.

6. The method of claim 1 wherein certain of the selectively actuated needles are elevated to a high knit level while others of the selected needles are elevated to a normal knit level whereby the said second yarn only is caught in the hooks thereof, while the first yarn is fed to the needles at a position below the latches thereon in selected wales of selected courses, whereby only the second yarn is formed into loops, while the first yarn is floated across said wales resulting in a lace-like appearance on the technical faceside and backside in certain of the wales of certain of the courses in the fabric.

7. The method according to claim 1 wherein the pattern wheels for effective needle selection and sinker selection are provided with the same number of cuts whereby the respective and resulting pattern areas may be equal in width and depth.

8. The method according to claim 7 whereby the sinker pattern wheel set-out and the needle pattern wheel set-out may be more simply and more expeditiously complemented with respect to each other whereby when terry selection by sinker pattern wheel means stops in selected areas of the fabric, stitch selection by needle pattern wheel means commences immediately in areas complementary to said selected areas, and vice versa.

9. A method of knitting a decorative fabric on a circular knitting machine having independent sinker selection capabilities for activating sinkers at a single level between a first retracted non-terry loop forming position in which the nib of the sinker is out of the path of the yarn caught in the hooks of needles on either side thereof and a second advanced terry loop forming position in which the nib of the sinker is in the path of the yarn caught in the hooks of needles on either side thereof, independent needle selection capabilities for selectively activating needles to a plurality of different heights, and a plurality of feeds comprising alternate feeds and intermediate feeds, said method comprising the steps of:

(a) introducing in at least one of said alternate feeds at least a first ground yarn at substantially a sinker throat level and at least a second yarn at a higher level above the nibs of the sinkers;

(b) selectively activating at the same ones of said alternate feeds selected ones of said sinkers according to a prescribed pattern to said second position for forming elongated or terry loops of said second yarn over the nibs of said sinkers in selected areas of said decorative fabric;

(c) at times when said sinkers operative at the said ones of said alternate feeds are in said first retracted non-terry loop forming positions, selectively activating at the same ones of said alternate feeds selected ones of said needles to form knit, tuck and welt combinations with at least one of said first and second yarns;

(d) intermediate feeds of said plurality of feeds in complementary cooperation with said alternate feeds;

(e) as the needles approach certain of said intermediate feeds in selected feeds of said intermediate feeds, selected ones of said needles are raised to a tuck level while others of said needles remain unselected at a welt level and certain of said sinkers remain in said first retracted position whereby a third yarn is introduced into the fabric in a non-knit manner.

10. The method according to claim 9 wherein said third yarn is laid-in successive courses according to a prescribed pattern.

11. The method according to claim 9 wherein the terry loops are subjected to a shearing operation to form a velour effect in said selected areas.

* * * * *